United States Patent [19]

Martinec

[11] Patent Number: 4,507,819

[45] Date of Patent: Apr. 2, 1985

[54] POWER NOZZLE SUDSER FOR CANISTER TYPE VACUUM CLEANER

[75] Inventor: Eugene F. Martinec, East Cleveland, Ohio

[73] Assignee: Health-Mor, Inc., Chicago, Ill.

[21] Appl. No.: 580,737

[22] Filed: Feb. 16, 1984

[51] Int. Cl.[3] ..... A47L 11/34

[52] U.S. Cl. ..... 15/321; 15/50 C; 15/328; 15/377; 239/343

[58] Field of Search ..... 15/50 R, 50 C, 320, 15/321, 377, 328; 239/343

[56] References Cited

U.S. PATENT DOCUMENTS

| | | | |
|---|---|---|---|
| 2,334,914 | 11/1943 | Erickson | 15/320 X |
| 2,635,278 | 4/1953 | Belknap | 15/377 X |
| 2,735,125 | 2/1956 | Erbs | 15/320 X |
| 2,818,596 | 1/1958 | Martinec | 15/327 |
| 3,200,433 | 8/1965 | Downey | 15/377 X |
| 3,343,344 | 9/1967 | Fairaizl et al. | 55/376 |
| 3,370,315 | 2/1968 | MacFarland et al. | 15/320 |
| 3,751,747 | 8/1973 | Blaeldh | 15/321 X |
| 3,818,540 | 6/1974 | Martinec et al. | 15/377 X |
| 4,023,234 | 5/1977 | Martinec et al. | 15/331 |
| 4,176,421 | 12/1979 | Baird | 15/320 |

*Primary Examiner*—Chris K. Moore

*Attorney, Agent, or Firm*—Frease & Bishop

[57] ABSTRACT

A typical power nozzle for a canister type vacuum cleaner is modified by omitting nozzle adjustment and other components, and by adding a tank for suds solution, a suds control unit, and a modified nozzle housing bottom plate which slides on the floor covering being suds-scrubbed. The sudser is used as a substitute for a typical power nozzle connected in a canister type cleaner system with the blower outlet of the power unit of the canister, in a suds-scrubbing operation. After scrubbing, a typical power nozzle is connected in the usual manner in the system, to perform normal cleaning of the area scrubbed.

11 Claims, 21 Drawing Figures

POWER NOZZLE SUDSER FOR CANISTER TYPE VACUUM CLEANER

CROSS-REFERENCE TO RELATED PATENTS

The new power nozzle sudser is an improvement upon power nozzles of the several types shown in U.S. Pat. Nos. 3,818,540 and 4,023,234, used with canister type vacuum cleaners of the general type shown in U.S. Pat. Nos. 2,818,596 and 3,343,344.

BACKGROUND OF THE INVENTION

1. Field of the Invention

The invention relates to a simplified sudser device assembled with certain components of a vacuum cleaner nozzle of the type known as a power nozzle which has a power-driven brush in a nozzle housing having communication through a tubular manipulating wand connected by a hose with a blower outlet of a typical tank or canister type cleaner. Other power nozzle components are eliminated. The blower connection blows air under pressure into the nozzle housing which is otherwise closed except for the nozzle opening for the power-driven brush which is operated for suds-cleaning carpets, rugs or various other types of floor coverings.

More particularly the invention relates to the simple addition to a modified power nozzle of a liquid containing tank, a valve mechanism, fluid passages communicating between the interiors of the tank and the nozzle housing controlled by the valve mechanism, and suds forming components.

Furthermore, the invention relates to a simplified construction of a power nozzle housing, an associated concentrated sudsing liquid containing tank, and valve mechanism, in which the valve mechanism may be actuated to control the rate of discharge of suds from the nozzle brush opening adjacent the rotating power-driven brush for suds scrubbing of floor covering material being cleaned, by a valve control actuator available to the person operating the nozzle adjacent the wand handle of the power nozzle.

Further, the invention relates to equipment which may be easily, rapidly and normally used to accomplish domestic or household suds cleaning of floor coverings as a part of everyday home use of canister type vacuum cleaner, without time-consuming rebuilding of an upright cleaner to introduce and remove special components in the upright cleaner assembly; by providing a pair of power nozzle type attachments for a canister cleaner, the first a power nozzle sudser attachment which is connected with the blower outlet of the canister and used initially for suds cleaning, followed by use of a usual power nozzle attachment connected with the suction outlet of the canister for dry suds and dirt removal.

2. Description of the Prior Art

Traditionally carpets, rugs and other floor coverings have been scrubbed with suds or similar cleaning solutions directly on household floor areas in a number of different ways. One cleaning procedure involves employing a commercial cleaner who cleans with special commercial equipment.

Another procedure involves renting special cleaning units to which cleaning fluid is supplied for scrubbing the floor covering.

Another procedure is to hand scrub the floor covering with brushes and cleaning solution.

Still another procedure involves spreading suds from a suds producing tool onto the floor covering, then scrubbing with scrub brushes, and then after drying proceeding with a normal vacuum cleaning operation.

Recently special conversion kits have been proposed and supplied for temporary assembly with a typical upright floor type vacuum cleaner. The use of this conversion equipment involves removing the cleaner nozzle and assembling a tray thereto, mounting and locking the nozzle-tray assembly on the cleaner housing over the motor shaft, removing the dust bag from the cleaner housing outlet, assembling on and connecting a tank to said housing outlet, connecting one end of a hose to an outlet opening of the tank, and connecting the other end of said hose to a hole in the tray. The tank is filled with a suds-making solution and the unit operated to discharge and brush suds onto the area being cleaned. Subsequently the described assembled components are removed and the cleaner restored to its normal upright cleaner assembly which is then used in a normal fashion to clean the floor covering after the same has dried.

The substantially complete dismantling of such upright cleaner to discharge suds on and brush suds into the floor covering is very time-consuming and complicated, as also is the restoration of the upright cleaner to normal assembly so that it may be used normally as a vacuum cleaner.

Accordingly, prior art procedures and equipment are expensive, or messy, or inadequate, or time-consuming and, thus, unsatisfactory from the standpoint of expense, results or time and effort involved in accomplishing suds cleaning.

Thus, there has long existed in the household cleaning field a need for simple, inexpensive, readily usable, reliable, efficient and practical equipment for householders' convenient and prompt use at any time, or during normal or scheduled vacuum cleaning of home floor areas for suds-cleaning floor coverings on such floor areas.

SUMMARY OF THE INVENTION

Objectives of the invention include providing a sudser attachment for a canister type vacuum cleaner using some existing power nozzle components and eliminating others and assembling special sudser components to form a power nozzle sudser attachment twin of a usual power nozzle attachment for a canister type vacuum cleaner so that the power nozzle sudser attachment may be used initially for suds cleaning supplied by air under pressure from the canister cleaner and then after the suds-scrubbed area has dried the usual power nozzle twin attachment is used for normal vacuum cleaning of suds residue and dirt contained therein; providing such sudser construction in which suds solution-containing tank and suds control components are added to components of a typical power nozzle for providing in a simple and readily manufactured manner a power nozzle sudser attachment twin for a typical power nozzle attachment for a canister type vacuum cleaner; providing such sudser attachment with simple control means communicating between the solution-containing tank equipped power nozzle which may be manipulated by the user to discharge suds at a desired, selected or controlled rate and selectively to instantly stop the formation and discharge of suds from the power nozzle sudser attachment by the simple manipulation of a control line or cable accessible at or adjacent the handle of the power nozzle sudser manipulating wand; providing such sudser attachment in which the suds are formed in a power-driven brush containing portion of a typical vacuum cleaner power nozzle immediately adjacent the brush, from suds solution delivered from a suds solution-containing tank mounted on top of the nozzle housing; providing such canister vacuum cleaner sudser attachment which may be used at any time during routine household cleaning procedures to suds-scrub floor coverings without dismantling and reassembling vacuum cleaner equipment to convert such equipment from a normal cleaner to a sudser and vice versa; and providing a new power nozzle sudser attachment for canister type vacuum cleaners which achieves the stated objectives, eliminates numerous problems that have been encountered in the use of prior procedures and equipment for household rug suds-cleaning and the like, and satisfies a need that has long existed in the art.

These and other objectives and advantages may be obtained by the construction stated in general terms as including in a power nozzle for a canister vacuum cleaner of a type in which the canister power unit housing has spaced blower and suction outlets, in which the power nozzle has a nozzle housing and a power-driven brush operative through a brush opening in the nozzle bottom plate to brush floor areas engaged by said nozzle, and in which said nozzle communicates through a tubular manipulating wand and a flexible hose with a housing outlet, wherein the improvement comprises a construction wherein the nozzle housing has housing top and side walls and a flat bottom plate adapted for sliding engagement with a floor area being cleaned, and said housing walls and bottom plate form a compartment; a suds solution-containing tank mounted on the housing top wall; suds control means having a partition portion located in said compartment dividing said compartment into a pressure section, and a brush section in which said power-driven brush is located; said control means having a mounting portion extending from said partition portion through said housing top wall into the tank; first passage means formed in said mounting portion communicating between said compartment pressure section and the interior of the tank; the control means partition portion being formed with an air-fluid chamber having a screen-contained discharge outlet, and an inlet communicating with said pressure section; second passage means extending through said mounting and partition portions from a zone adjacent the bottom of the tank to said chamber inlet; said control means also including first and second valves, respectively, for said first and second passage means; a valve actuator movably mounted in the tank on said mounting portion having first and second valve closure members, respectively, for said first and second valves; said actuator being biased normally to a valve control closed position in which the first closure member closes said first valve and said second valve is open; said control means also including a control member connected with said movable valve actuator and extending to a location outside the tank accessible at a handle portion of the manipulating wand, for moving said valve actuator from said normal valve control closed position to a desired degree of opening of said first valve; and the nozzle hose being connected with the blower outlet of said canister power unit housing; whereby when the canister power unit is energized, air under pressure is blown from the canister blower outlet into said pressure section through said first passage means into said tank establishing pressure on suds solution in the tank forcing solution in said tank to flow through said second passage into said air-fluid chamber inlet into air under pressure passing from said pressure section through said inlet and into said air-fluid chamber where said suds solution and air are mixed and blown through said screen contained discharge outlet to form suds in said housing brush section which are discharged through the bottom plate brush opening around the brush operating through said brush opening to suds-scrub floor covering on the floor area along which the nozzle is slidably moved back and forth for suds-cleaning, when said valve actuator is moved out of valve closed position.

BRIEF DESCRIPTION OF THE DRAWINGS

Preferred embodiments of the invention—illustrative of the best modes in which applicant has contemplated applying the pirnciples—are set forth in the following description and shown in the drawings and are particularly and distinctly pointed out and set forth in the appended claims.

Similar numerals refer to similar parts throughout the various figures of the drawings.

DESCRIPTION OF THE PREFERRED EMBODIMENTS

The new power nozzle sudser construction of the present invention involves modification of a typical power nozzle of the types generally shown in U.S. Pat. Nos. 3,818,540 and 4,023,234 in which I am one of the patentees.

Such modification involves the elimination of nozzle adjustment devices, rollers, and other components of the power nozzles shown in said patents while the nozzle housing, power-driven brush and tubular wand connector components are retained. Such modified prior power nozzle construction is further modified by the addition of a flat bottom plate with a brush opening for the housing. Thus the nozzle may slide on such bottom plate on a floor area being suds-scrubbed.

Further modifications involve the addition of a tank mounted on top of the housing for containing suds solution, and the addition of a suds control mechanism extending into the nozzle housing compartment and into the tank as described more in detail below.

Such modified power nozzle sudser is adapted to be connected by a typical vacuum cleaner wand and flexible hose with the blower outlet of a typical power unit of a canister type vacuum cleaner such as shown generally in my U.S. Pat. No. 2,818,596 and in Fairaizl and Martinec U.S. Pat. No. 3,343,344. The power-driven brush in the sudser is supplied by power from the canister power unit by an electrical cord, not shown, as in said power nozzle prior patents.

Figure 1:
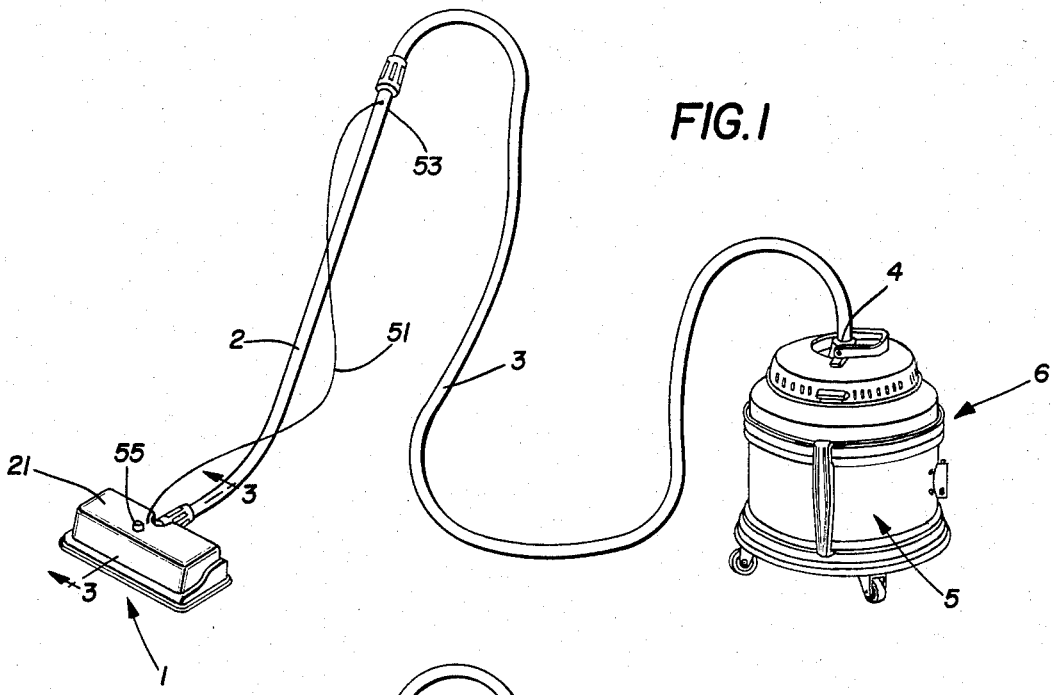
FIG. 1 is a somewhat diagrammatic perspective view of the new power nozzle sudser unit of the invention, connected by a wand and flexible hose with the blower outlet of a power unit housing of a typical canister type vacuum cleaner for discharging suds onto a floor covering to be suds-scrubbed.

The power nozzle sudser of the invention is generally indicated at 1 in FIG. 1 connected through a wand 2 and flexible hose 3 to the blower outlet 4 of the power unit 5 of a typical canister type vacuum cleaner indicated generally at 6. The canister vacuum cleaner 6, as indicated, may be of the types shown in said U.S. Pat. Nos. 2,818,596 and 3,343,344, the detailed description and illustration of which are incorporated by reference herein without repetition.

The various units and components, connected as illustrated in FIG. 1, are used as described below for suds-scrubbing rugs or other floor coverings.

Figure 2:
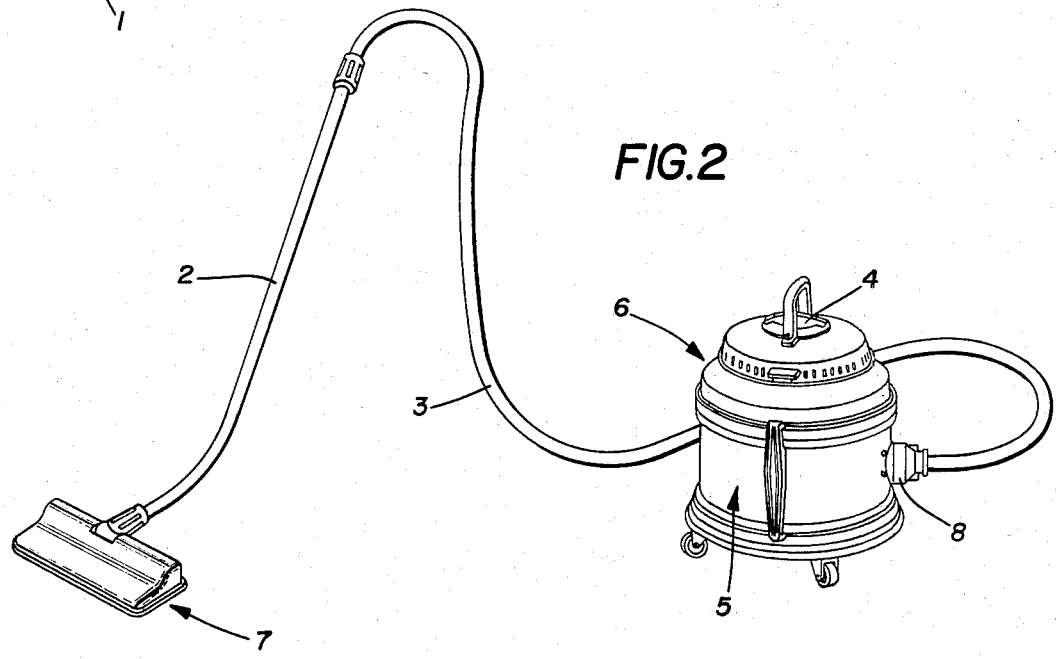
FIG. 2 is a view similar to FIG. 1 but showing a typical power nozzle connected with the suction inlet of a typical canister type vacuum cleaner for cleaning dry suds and loosened dirt from a floor covering after the suds-scrubbing operation of the sudser shown in FIG. 1.

FIG. 2 illustrates units and components that may be used for a typical vacuum cleaning operation (after suds-scrubbing using the equipment of FIG. 1), during which dry suds and loosened dirt are removed from the floor covering being cleaned.

The units and components of FIG. 2 include a typical power nozzle, generally indicated at 7, such as the type shown in said U.S. Pat. Nos. 3,818,540 and 4,023,234, the wand 2 and flexible hose 3 connected, however, to the suction outlet 8 of the canister vacuum cleaner 6.

Figure 5:
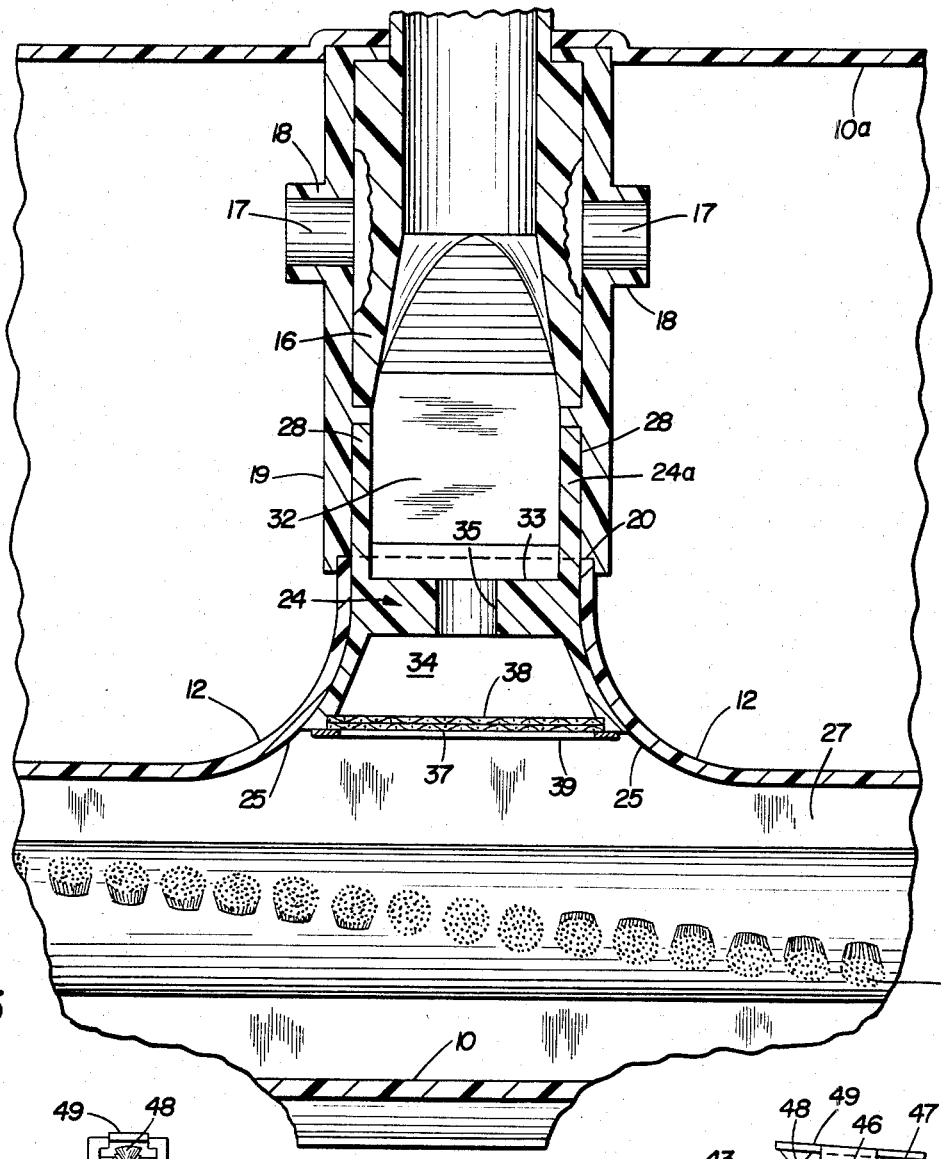
FIG. 5 is a fragmentary sectional view looking in the direction of the arrows 5—5, FIG. 3.
Figure 7:
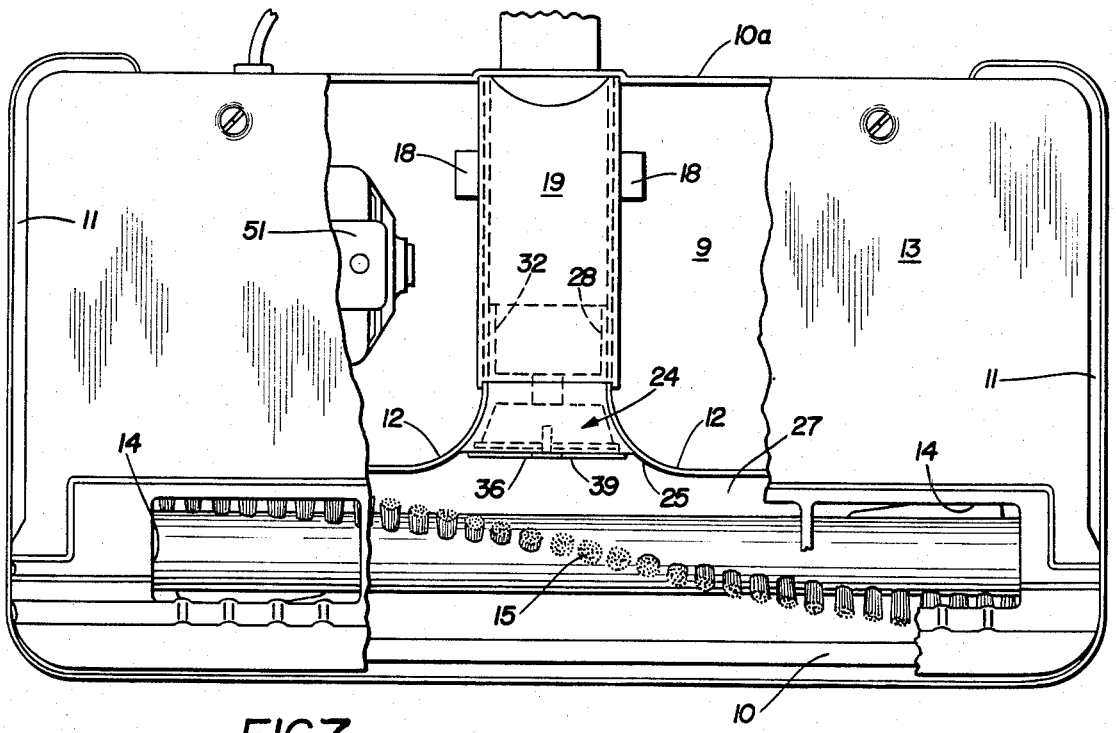
FIG. 7 is a bottom plan view of the power nozzle sudser shown in FIGS. 1, 3 and 4 with parts of the nozzle bottom plate cut away.

The housing of the power nozzle sudser 1 has a top housing wall 9, side walls 10 and **10*a*, end walls 11 similar to those in a typical power nozzle, and L-shaped divider walls 12 (FIGS. 5 and 7). In accordance with the invention, the housing side, end and L-shaped walls 10, 10*a*, 11 and 12 are closed by a flat bottom plate 13 having a brush opening 14 therein through which the brush 15 is operative to brush floor areas over which the sudser 1** may slide when moved back and forth for a suds-scrubbing operation.

The flat bottom plate 13 otherwise is imperforate and forms compartments within the housing, one being generally T-shaped defined by the L-shaped walls 12, the housing top wall 9 of the flat bottom plate 13. The stem of the T has a typical pivoted connector 16 mounted therein on pivot shafts 17 journaled in sleeves 18 carried by a U-shaped connector support bracket 19 recessed at 20 in the rear portions of the L-shaped walls 12. This connector mounting is typical of those in prior power nozzles.

A suds solution-containing tank 21 is mounted on the top housing wall 9 and registering openings 22 and 23 are formed, respectively, in the bottom tank wall and the top housing wall.

Suds control mechanism which may be a unit 24 (FIGS. 3 to 11) is mounted within the housing and tank. Unit 24 has a partition portion **24*a* located in the compartment formed by the L-shaped walls 12, the housing top wall 9 and the flat bottom plate 13 in the zone where the L-shaped walls 12 spread open at the corners 25 (FIGS. 3, 4, 5 and 7**).

The suds control unit 24 also has a mounting portion **24*b* which extends upward from said partition portion 24*a* through the openings 22 and 23 into the tank 21**.

The partition portion **24*a* thus divides the compartment formed by the housing walls and L-shaped walls 12 into a pressure section 26 extending between the partition portion 24*a* and connector 16, and a brush section 27 extending between the partition portion 24*a* and brush opening 14 in which the power-driven brush 15** is located.

The suds control unit 24 preferably is manufactured as a molded plastic material unit. Certain passages and a chamber are formed in the unit during molding.

The partition portion **24*a* (FIGS. 3, 4 and 9) has a rearwardly upwardly opening cavity 32 formed therein defined by U-shaped side walls 28 and a top wall 29 having an upwardly rearwardly angled inner surface 30**.

Figure 3:
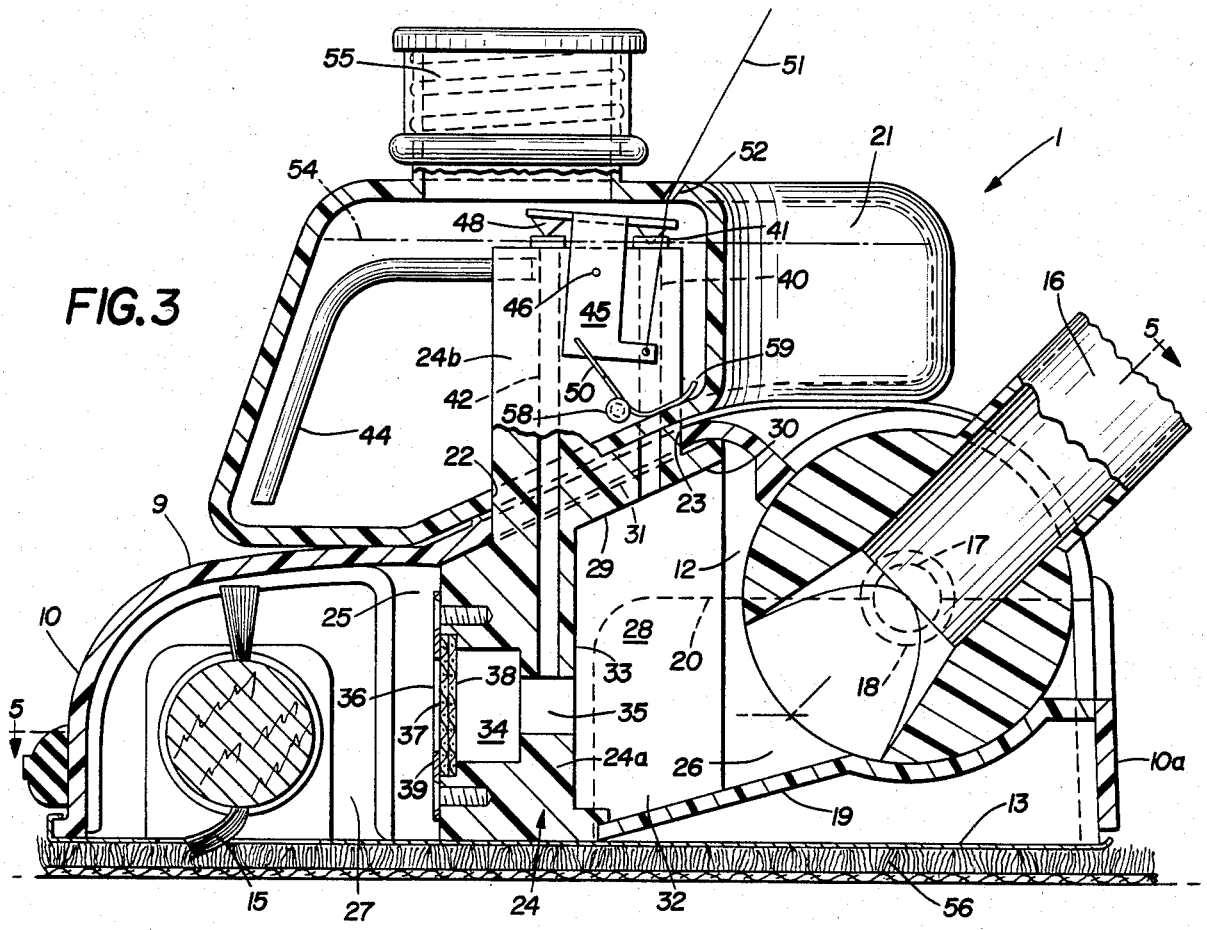
FIG. 3 is a cross-sectional view of the power nozzle sudser shown in FIG. 1 looking in the direction of the arrows 3—3, FIG. 1 with the suds control unit in valve closed position.
Figure 4:
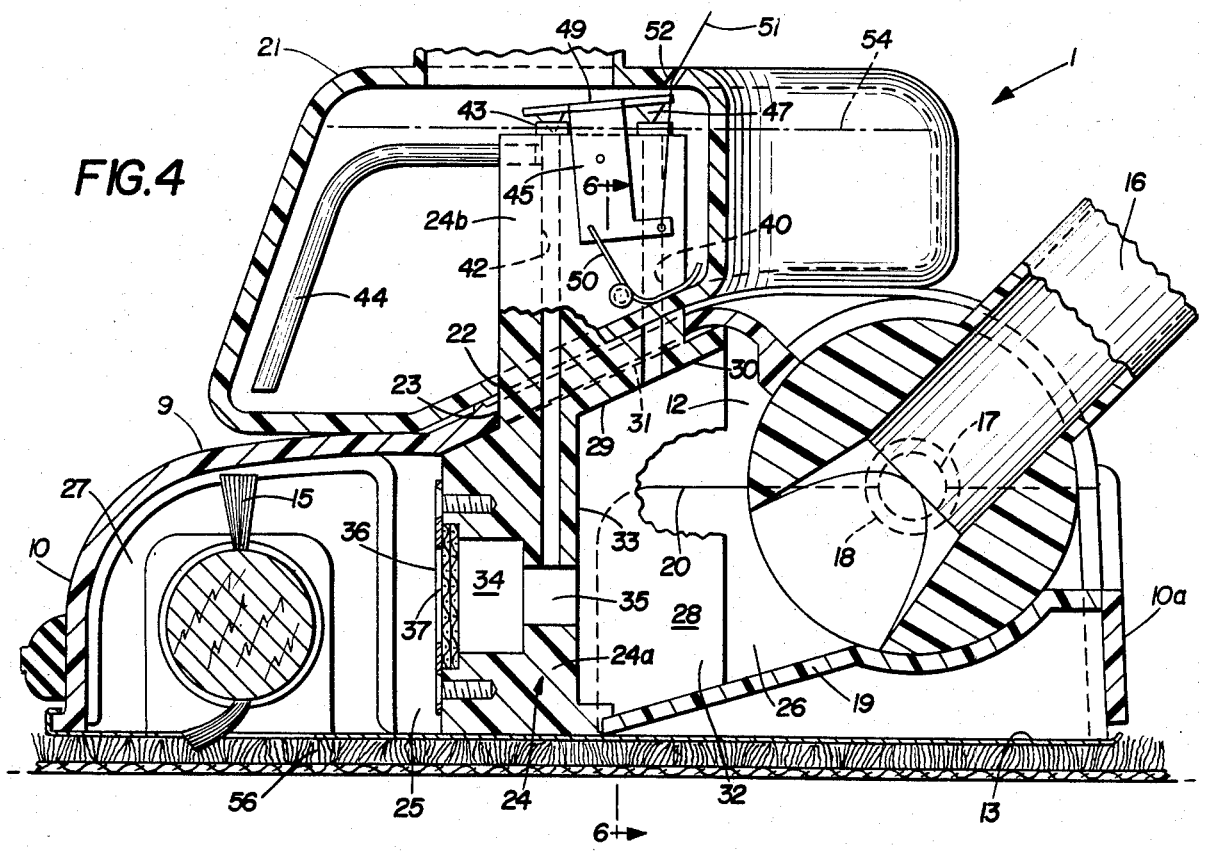
FIG. 4 is a view similar to FIG. 3 but showing the suds control unit in valve open position for generation and discharge of suds from the nozzle bottom plate brush opening.

The outer surface 31 of top wall 29 is similarly angled and engages the inside of the sudser housing top wall 9 when assembled in the housing, with the mounting portion **24*b* extending into tank 21 (as best shown in FIGS. 3 and 4**).

The cavity 32 also is defined by an inner vertical wall 33 extending downward from the top wall 29 and between the U-shaped side walls 28. The upper surface of the connector support bracket 19 forms a fifth cavity surface. Thus, the cavity 32 opens rearwardly (FIGS. 3 and 4) and communicates with the pressure section 26 of the nozzle housing compartment.

Figure 8:
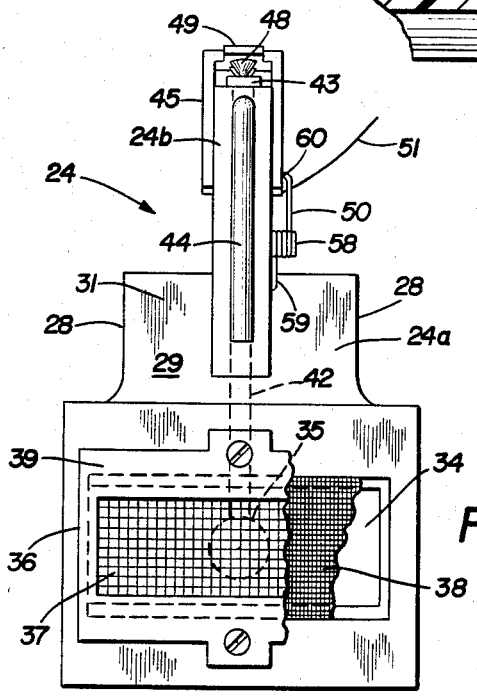
FIG. 8 is a front elevation of the suds control unit detached from the nozzle and with parts broken away to illustrate the suds forming fabric and protector screens.

The vertical wall 33 is formed with an air-fluid chamber 34 having an inlet 35 communicating between the chamber 34 and the cavity 32. The chamber 34 has a rectangular screen-contained discharge outlet 36 (FIG. 8). The screen for the outlet 36 includes an outer wire protector screen 37, and an inner fabric material suds screen 38 held in place by a retaining window bracket 39.

A first or intake passage 40 is formed in the mounting portion 24*b* of the suds control unit 24 extending upward from the cavity 32 to a valve seat 41 of a first valve. The passage 40 thus communicates between the pressure section 26 of the housing and the interior of the tank 21.

A second or outlet passage 42 is formed in the control unit 24 extending from a valve seat 43 of a second valve downward through the mounting and partition portions of the control unit 24 to the air-fluid chamber inlet 35. A gooseneck tube 44 is connected with the outlet passage 42 just below the valve seat 43 and extends to a zone just above the bottom of the tank 21 (FIGS. 3 and 4).

Thus, the outlet passage 42 and gooseneck tube 44 communicate between the lower portion of the tank 21 and the inlet 35 of the air-fluid chamber 34.

A U-shaped valve actuator 45 is pivotally mounted at 46 on the top end of the mounting portion 24*b* of the control unit 24 and first and second valve closure plugs 47 and 48 are carried by the actuator cross-head 49.

Figure 9:
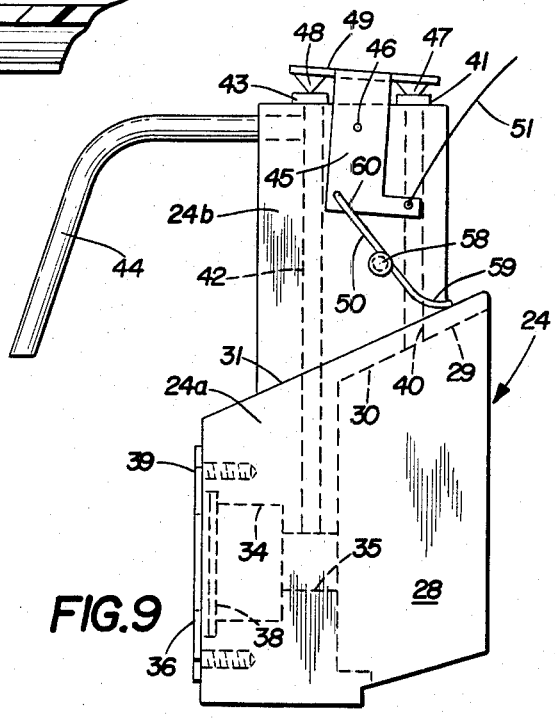
FIG. 9 is a side elevation of the suds control unit shown in FIG. 8.
Figure 10:
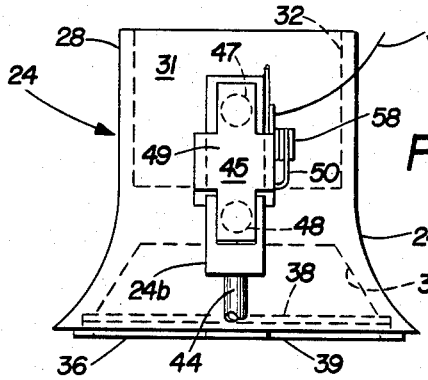
FIG. 10 is a top plan view of the suds control unit shown in FIGS. 8 and 9.

The valve plugs 47 and 48 alternately close one and open the other of the first and second valves. The actuator 45 is biased by a spring 50 (FIG. 11) normally to a valve control "closed" position as shown in FIGS. 3 and 9. In this position the first valve closure plug 47 seats on the first valve seat 41 and closes the first valve, while the second valve is opened.

A control cable 51, connected with the actuator 45 and extending through an opening 52 in the tank to an accessible location 53 adjacent a handle portion of the manipulating wand 2, may be pulled by the operator to move the valve actuator 45 to open the first valve from its normally closed position to a desired degree of opening, which may be to fully open the first valve and, thus, close the second valve by seating the plug 48 in the second valve seat 43.

A suds-scrubbing operation may be carried out using the power nozzle sudser 1 by filling the tank 21 to the liquid level 54 (not above the valve seats) with a suds forming solution. This is accomplished by removing the screw cap 55 for the tank inlet opening and pouring into the tank an instant suds concentrate of usual composition and water in the desired proportions to form a sudsing solution. The cap is then replaced and the sudser 1 connected with the blower outlet 4 of the power unit of the canister vacuum cleaner 6 as shown in FIG. 1.

The cleaner power unit 5 is then energized while supplies or blows air under pressure to the pressure section 26 of the sudser 1. This pressure condition blows air through the inlet 35 of the air-fluid chamber 34 and through the air-fluid chamber and screen assembly into the brush section 27 of the nozzle which is discharged through the brush opening 14.

The air pressure thus established in the pressure section 26 of the nozzle compartment is directed upward through passage 40. The operator then pulls cable 51 to move the valve actuator 45 out of valve "closed" position and air under pressure enters the top of the tank 21 above the liquid level 54 forcing the suds solution into gooseneck tube 44 and through passage 42 into inlet 35.

The suds solution liquid thus discharged into the inlet 35 is mixed in the chamber 34 with the air blowing through the inlet 35 from the pressure section 26. The air-fluid mixture thus formed then is blown through the screen assembly which creates suds discharged from the discharge outlet 36 into the brush section 27 and out of the brush opening 14 onto a rug or other floor covering 56 being suds-scrubbed by movement of the sudser 1 back and forth slidably on the rug 56.

Meanwhile, the brush is power driven in the usual manner by the brush motor 57 energized in the usual manner of operating known power nozzles by supplying power through wiring, not shown, connected along the wand and flexible hose with the vacuum cleaner power unit.

The volume of suds produced and rate of discharge from the sudser may be controlled and varied by manipulation of the control cable 51 to change the degree of opening of the first valve at the top of the first or inlet passage 40.

When sudsing operation is complete, cable 51 is released and spring 50 moves the actuator 45 to valve "closed" position, interrupting air pressure in the tank. At this time the second valve is opened providing an open valve seat 43 communicating with the second passage 42 breaking the siphoning action which otherwise would occur in the outlet passage 42 through its connection in the gooseneck pipe 44 with solution in the tank.

Figure 11:
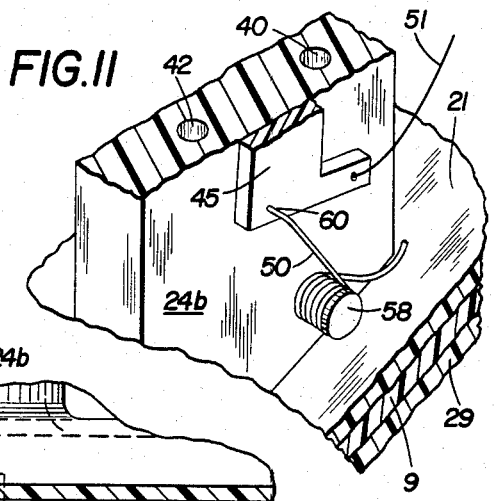
FIG. 11 is a fragmentary perspective view of a portion of FIG. 10.
Figure 6:
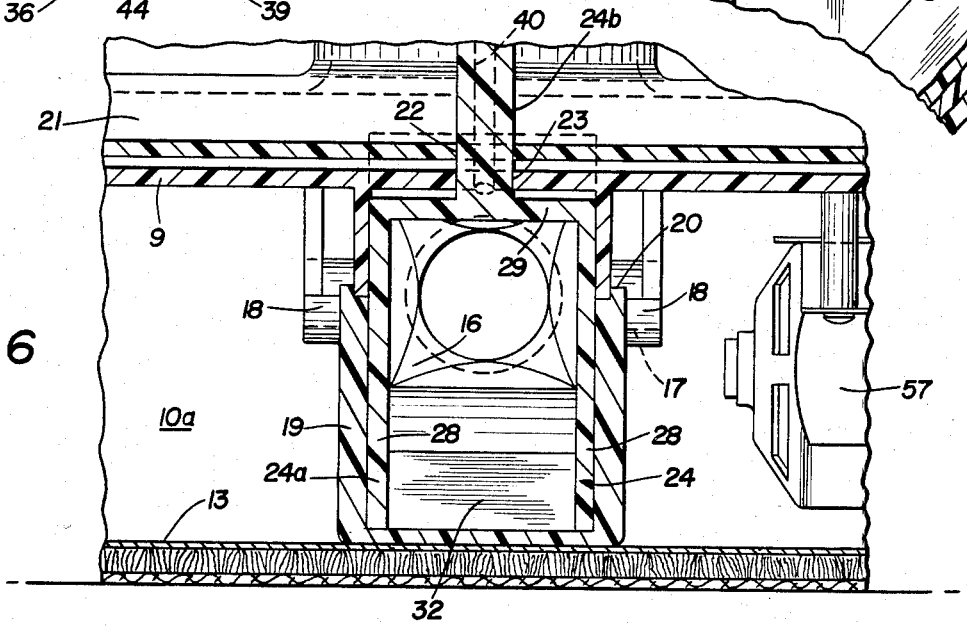
FIG. 6 is a fragmentary sectional view looking in the direction of the arrows 6—6, FIG. 4.

Spring 50 has been referred to for normally biasing the valve actuator 45 to valve "closed" position. Referring particularly to FIGS. 8, 9, 10 and 11, this spring 50 is a simple wraparound coil spring mounted on a spring post 58 with the inner end 59 of the spring projecting along a corner between the inner angular upwardly extending surface of the tank bottom wall and the mounting portion 24*b*, as best shown in FIG. 11. The outer end 60 of spring 50 is angled upwardly and then projects toward the valve actuator 45 to which it is connected, also as best shown in FIG. 11.

Suds-scrubbing may be accomplished in the manner described. If the area being scrubbed is large, the tank 21 may be refilled from time to time with suds concentrate diluted to the desired concentration with water being sure that the water level must not be above the valve inlets.

Following completion of a suds-scrubbing operation, the area scrubbed is subjected to a typical vacuum cleaning operation with the equipment of FIG. 2 as described above.

The sudser of the invention, as compared with commercial suds cleaning units, rented units, and proposed floor type cleaner reconstruction, has few uncomplicated components which are added to a conventional stripped-down power nozzle. The added components generally include a simple tank, the suds control unit and the modified flat bottom plate. Thus, the cost of the sudser is relatively low because of the simple additional parts involved and the fact that components of standard power nozzles may be used for construction of the power nozzle sudser 1.

Further, the improved sudser is operated and manipulated in the same manner as a typical power nozzle by movement back and forth across a floor being suds-scrubbed or suds-cleaned. The generation and discharge of suds from the nozzle may be readily controlled during the suds-scrubbing operation conveniently by the control cable 51.

Figure 12:
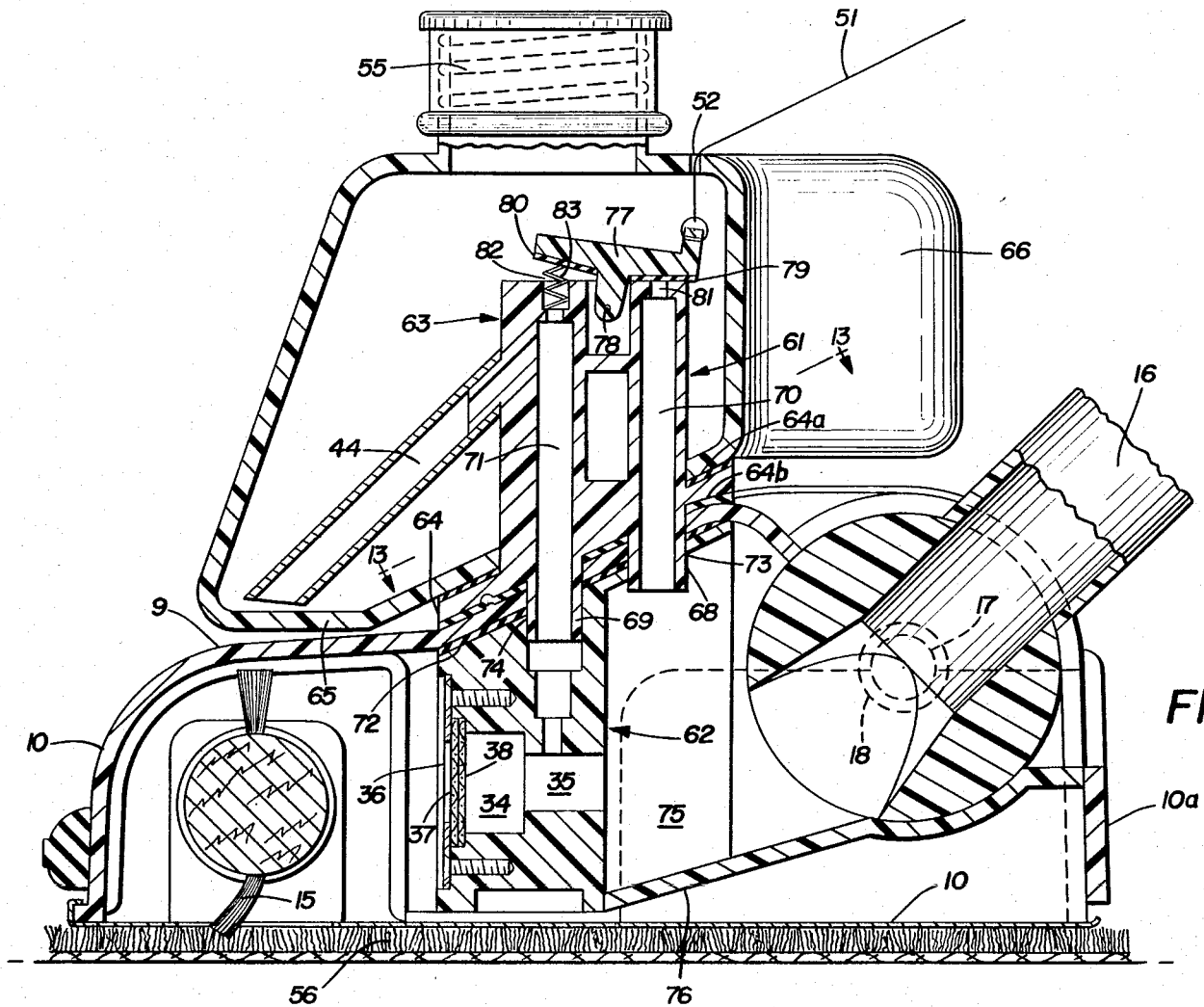
FIG. 12 is a view similar to FIG. 3 illustrating an alternate form of control means for the sudser.
Figure 14:
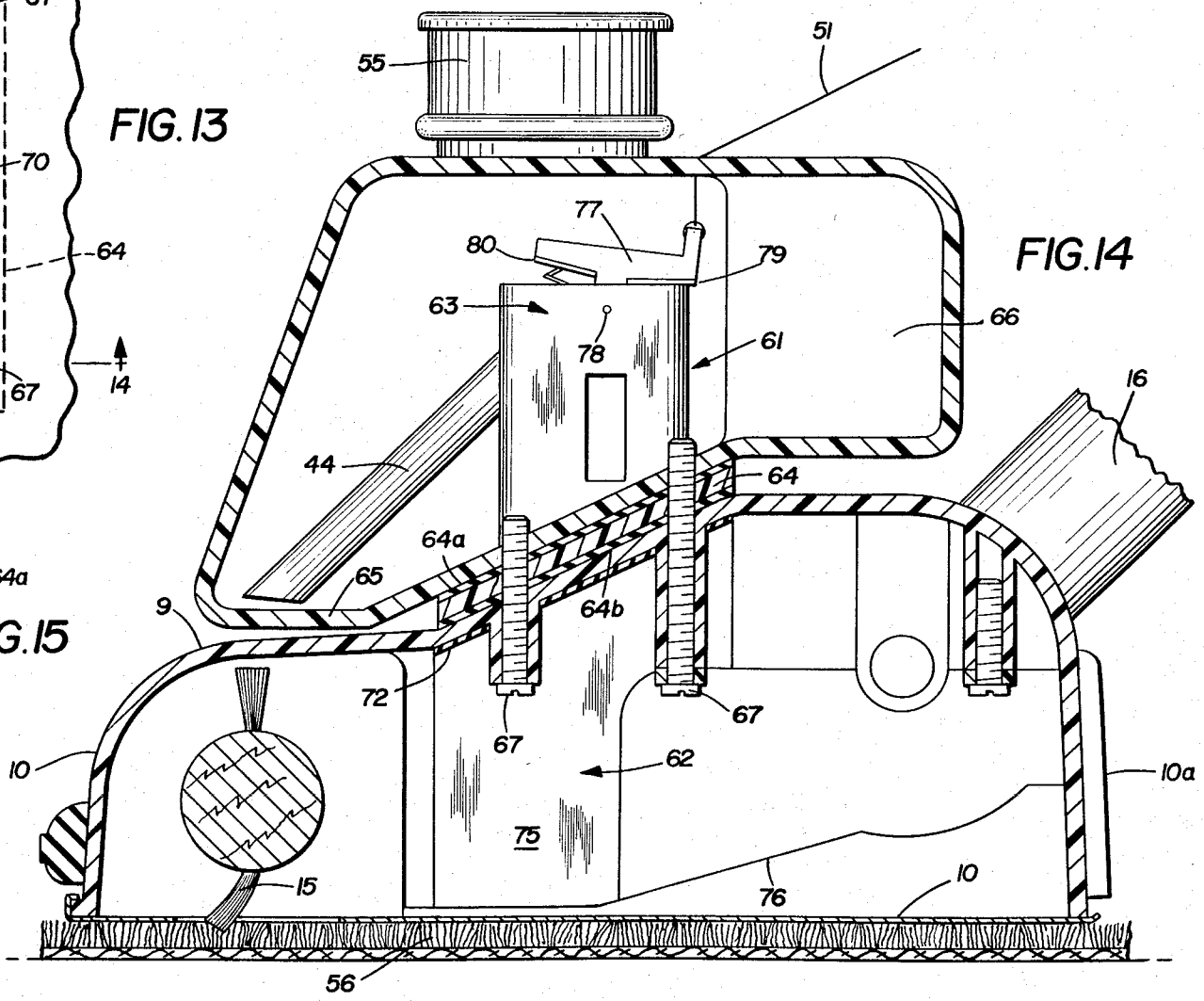
FIG. 14 is a sectional view similar to FIG. 12, but looking in the direction of the arrows 14—14, FIG. 13, showing the bolted connection between the top and lower members of the control mechanism and the tank and the top housing wall of the alternate form of control mechanism of FIG. 12.
Figure 13:
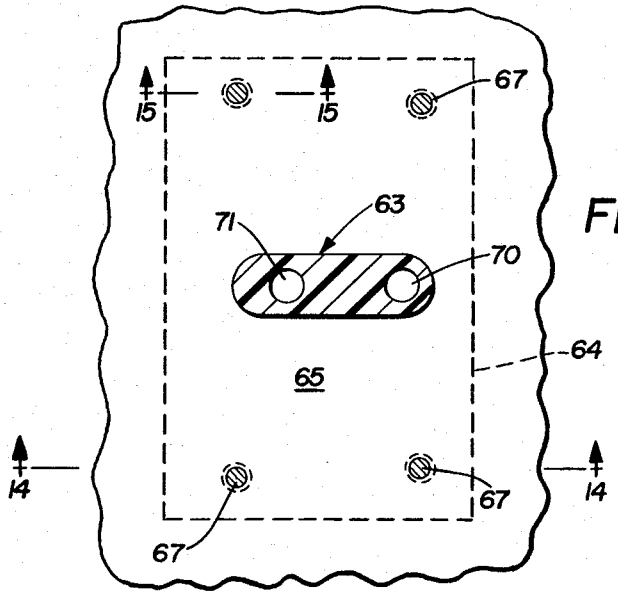
FIG. 13 is a fragmentary plan sectional view taken on the line and looking in the direction of the arrows 13—13, FIG. 12.

An alternate construction of the sudser control mechanism is shown in FIGS. 12, 13 and 14. This alternate form of construction functionally and operationwise is the same as the sudser control mechanism or unit 24 shown and described in FIGS. 3 to 11 except that the mechanism shown particularly in FIG. 12 has a two-piece body and the pieces or members are joined together, in contrast to the sudser unit 24 illustrated, for example, in FIGS. 3, 8 and 9.

The alternate two-piece control mechanism is generally indicated at 61 and comprises a partition portion or lower control mechanism member generally indicated at 62 constructed substantially the same as the partition portion 24*a* of control unit 24; and a mounting portion or top control mechanism member generally indicated at 63 having a construction similar to the mounting portion 24*b* of control unit 24.

The top member 63 has a slanting preferably rectangular mounting flange 64 engaging a gasket 64*a* (FIG. 15) between flange 64 and the undersurface of the bottom wall 65 of the tank 66. The remainder of member 63 projects upward from the flange 64 into the tank 66.

Figure 15:
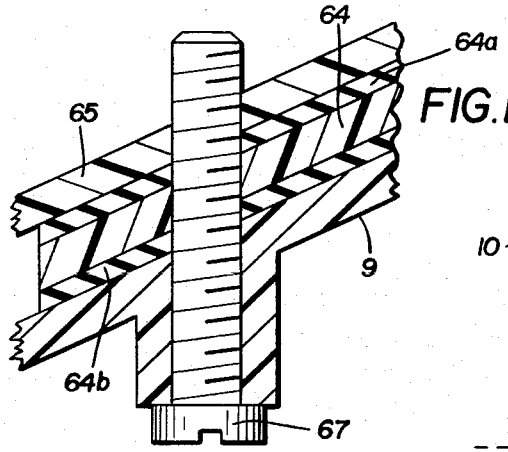
FIG. 15 is an enlarged fragmentary sectional view taken on the line 15—15, FIG. 13, showing the gasket seals between the mounting plate of the top control mechanism member and the bottom tank wall and the top housing wall.
Figure 16:
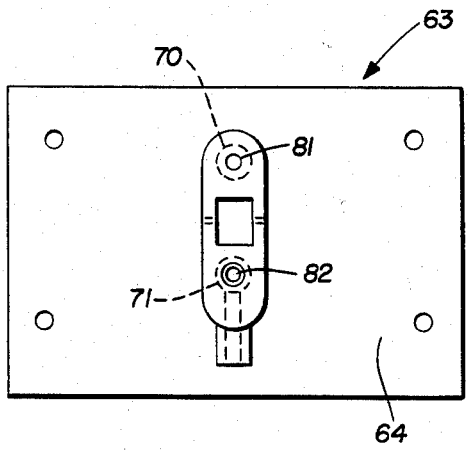
FIG. 16 is a top plan view of the top member of the control mechanism shown in FIGS. 12, 13 and 14, with the valve removed.
Figure 18:
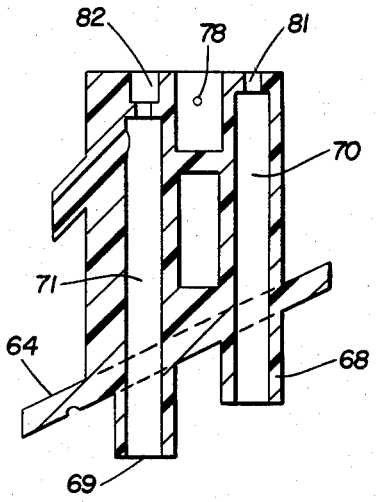
FIG. 18 is a sectional view looking in the direction of the arrows 18—18, FIG. 17.
Figure 17:
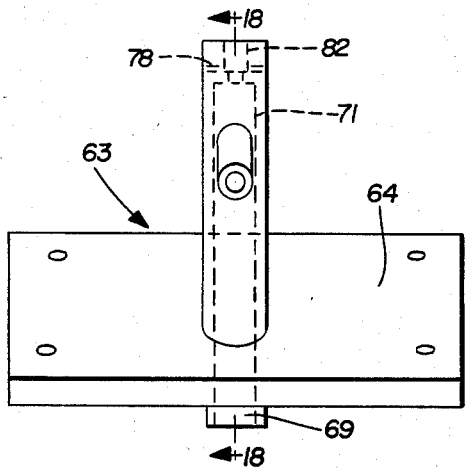
FIG. 17 is a front elevation of the top control member shown in FIG. 16.

In assembling the various components of the sudser, the underside of the flange 64, engaged by a gasket 64*b*, is joined to the top housing wall 9 of the nozzle as well as to the lower control mechanism member 62 by screws or bolts 67 located at the corners of the flange 64 (FIGS. 13, 14 and 15).

Member 63 has first and second tubular extensions 68 and 69 for their respective first and second passages 70 and 71. These extensions 68 and 69 extend through openings provided in the top housing wall 9.

Figure 19:
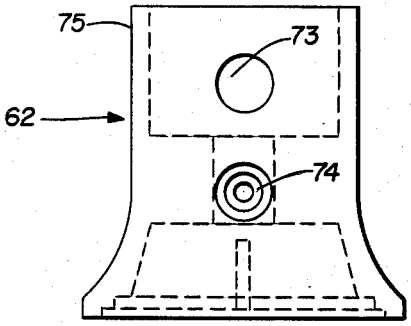
FIG. 19 is a top plan view of the lower member of the control mechanism.
Figure 21:
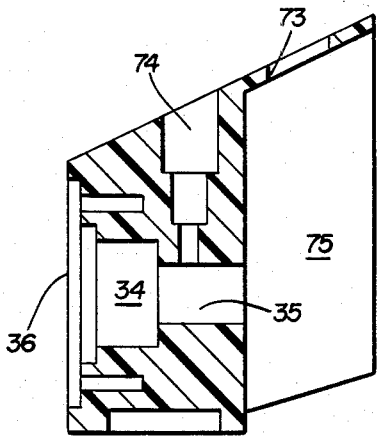
FIG. 21 is a sectional view taken on the line 21—21, FIG. 20.
Figure 20:
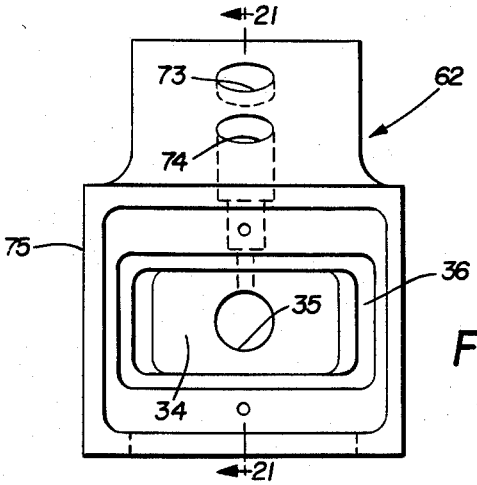
FIG. 20 is a front elevation of the lower control mechanism member shown in FIG. 19 with the screen removed.

The lower member 62 of the control mechanism 61 (FIGS. 19, 20 and 21) is assembled within the housing below top housing wall 9 with a gasket 72 between the upper surface of member 62 and the undersurface of top housing wall 9. The tubular extensions 68 and 69 are inserted in openings 73 and 74, respectively, formed in member 62 to locate members 62 and 63 in proper position. The member 62 is thus clamped in position against top housing wall 9 by engagement of the lower ends of the U-shaped side walls 75 of member 62 against the U-shaped support bracket 76.

The valve actuator 77 is pivotally mounted at 78 on the upper end of the top or mounting member 63 having first and second valve closures 79 and 80, respectively, for first and second valve seats 81 and 82.

Valve actuator 77 is biased normally to the valve-closed position shown in FIG. 12 by a coil spring 83. The coil spring is located in an opening portion of the valve seat 82 which, in turn, is located at the top of the second passage 71.

The alternate sudser control mechanism 61, which is formed of two members connected together, when so connected forms a sudser control unit, and, thus, the term "sudser control unit" as used herein comprehends a mechanism which may be formed of one or two pieces.

Accordingly, the new power nozzle sudser with a control mechanism having either a one- or two-piece construction, and its construction and operation satisfy the stated objectives; overcome problems that have been encountered with the use of prior equipment for suds-scrubbing floor coverings; and satisfy needs existing in the art in a practical, efficient and inexpensive manner.

In the foregoing description, certain terms have been used for brevity, clearness and understanding but no unnecessary limitations are to be implied therefrom beyond the requirements of the prior art because such terms are used for descriptive purposes and are intended to be broadly construed.

Moreover, the description and illustration of the invention is by way of example, and the scope of the invention is not limited to the exact details shown or described.

Having now described the features, principles and cooperative relationships of the new structures, and the advantageous, new and useful results obtained, the new structures, devices, components, elements, arrangements, parts, combinations and relationships are set forth in the appended claims.

I claim:

1. In a power nozzle for a canister vacuum cleaner of a type in which the canister power unit housing has spaced blower and suction outlets, in which the power nozzle has a nozzle housing and a power driven brush operative through a brush opening in the nozzle bottom plate to brush floor areas engaged by said nozzle, and in which said nozzle communicates through a tubular manipulating wand and a flexible hose with a housing outlet, wherein the improvement comprises a construction wherein (a) the nozzle housing has housing top and side walls and a flat bottom plate adapted for sliding engagement with a floor area being cleaned, and said housing walls and bottom plate form a compartment;

(b) a suds solution-containing tank mounted on the housing top wall;

(c) suds control means having a partition portion located in said compartment dividing said compartment into a pressure section, and a brush section in which said power driven brush is located;

(d) said control means having a mounting portion extending from said partition portion through said housing top wall into the tank;

(e) first passage means formed in said mounting portion communicating between said compartment pressure section and the interior of the tank;

(f) the control means partition portion being formed with an air-fluid chamber having a screen-contained discharge outlet, and an inlet communicating with said pressure section;

(g) second passage means extending through said mounting and partition portions from a zone adjacent the bottom of the tank to said chamber inlet;

(h) said control means also including first and second valves, respectively, for said first and second passage means;

(i) a valve actuator movably mounted in the tank on said mounting portion having first and second valve closure members, respectively, for said first and second valves;

(j) said actuator being biased normally to a valve control closed position in which the first closure member closes said first valve and said second valve is open;

(k) said control means also including a control member connected with said movable valve actuator and extending to a location outside the tank accessible at a handle portion of the manipulating wand, for moving said valve actuator from said normal valve control closed position to a desired degree of opening of said first valve; and (l) the nozzle hose being connected with the blower outlet of said canister power unit housing;

(m) whereby valve actuator is moved out of valve closed position when the canister power unit is energized, air under pressure is blown from the canister blower outlet into said pressure section through said first passage means into said tank establishing pressure on suds solution in the tank forcing solution in said tank to flow through said second passage into said air-fluid chamber inlet into air under pressure passing from said pressure section through said inlet and into said air-fluid chamber where said suds solution and air are mixed and blown through said screen contained discharge outlet to form suds in said housing brush section which are discharged through the bottom plate brush opening around the brush operating through said brush opening to suds-scrub floor covering on the floor area along which the nozzle is slidably moved back and forth for suds-cleaning.

2. The construction defined in claim 1 in which the tank has a top fill opening above the nozzle housing closed by a removable cap; and in which said fill opening also is above the suds control means valves inside the tank; whereby the tank may be filled through said top fill opening with suds solution to a liquid level located below said valves.

3. The construction defined in claim 1 in which said suds control means includes a molded control unit wherein the partition portion of said unit has a top wall extending angularly upwardly rearwardly in the nozzle compartment pressure section; in which said top wall has an upper surface engaging the inner surface of the housing top wall when the control unit is assembled with the housing and tank; and in which said first passage means includes a cavity formed in said partition portion communicating with said compartment pressure section, and also includes a tubular intake passage extending upward in said mounting portion from said cavity to the interior of the tank.

4. The construction defined in claim 3 in which said air-fluid chamber inlet communicates with said pressure section through said cavity; whereby air under pressure blown into said pressure section and cavity supplies air pressure to both said first tubular intake passage and said air-fluid chamber for mixing suds solution and air in said air-fluid chamber when said valve actuator is moved out of valve closed position.

5. The construction defined in claim 4 in which said valve actuator is biased normally to valve closed position by spring means mounted on said control unit mounting portion in said tank.

6. The construction defined in claim 5 in which the valve actuator is biased by a coil spring located in the second valve seat opening portion of said second passage means.

7. The construction defined in claim 4 in which said second passage means includes a tubular outlet passage formed in said control unit extending upward from said air-fluid chamber inlet to the interior of said tank below each of said valves, and said second passage means also includes a gooseneck tube communicating in the mounting portion with said outlet passage and having an open end located at a zone adjacent the bottom of said tank.

8. The construction defined in claim 1 in which said valve actuator is pivotally mounted in the tank on the upper end of the control unit mounting portion; in which said first and second valves include valve closure members on the actuator and valve seats located at the ends, respectively, of said intake and outlet passages in the tank; in which said valve actuator is moved by a control cable connected with said actuator and extending through an opening in the tank wall to a location where it may be pulled to move the valve actuator from biased normally valve closed position to a fully opened position; in which when said actuator is in said biased normal position the first valve closure member seats on the first valve seat and the second valve is open; in which when said actuator is moved by said control cable to fully open position the second valve closure member seats on the second valve seat; and in which the degree of actuator movement between valve closed and fully open position by movement of said control cable determines the rate of suds generation when air under pressure is blown into the housing pressure section.

9. The construction defined in claim 1 in which the air-fluid chamber screen-containing discharge outlet comprises a suds discharge opening formed in the control means partition portion communicating with the nozzle compartment brush section; and in which protector wire and fabric sudsing screens are located in said discharge opening between said air-fluid chamber and said brush section; whereby suds are generated by said screens as a mixture of air and suds solution is blown through said screens into the nozzle compartment brush section.

10. The construction defined in claim 1 in which the sudser control means partition and mounting portions are a one-piece unit.

11. The construction defined in claim 1 in which the sudser control means partition and mounting portions are separate members connected together to form a sudser control unit.

* * * * *